United States Patent [19]

Heenan et al.

[11] 4,224,002

[45] Sep. 23, 1980

[54] HIGHWAY DELINEATOR

[75] Inventors: Sidney A. Heenan, Park Ridge; Robert M. Flanagan, Lincolnshire, both of Ill.

[73] Assignee: Amerace Corporation, New York, N.Y.

[21] Appl. No.: 931,012

[22] Filed: Aug. 4, 1978

[51] Int. Cl.[2] ..... E01F 9/00

[52] U.S. Cl. ..... 404/9; 256/1; 256/13.1; 404/16

[58] Field of Search ..... 404/9, 12, 6, 8, 16; 256/13.1, 1

[56] References Cited

U.S. PATENT DOCUMENTS

| | | | |
|---|---|---|---|
| 3,114,303 | 12/1963 | Oberbach | 256/13.1 X |
| 3,214,142 | 10/1965 | Brown | 256/13.1 |
| 3,516,337 | 6/1970 | Gubela | 404/9 |
| 3,924,929 | 12/1975 | Holmen | 404/9 X |
| 4,035,059 | 7/1977 | DeMaster | 404/9 X |
| 4,123,181 | 10/1978 | Schueler | 404/9 |

*Primary Examiner*—Nile C. Byers, Jr.

*Attorney, Agent, or Firm*—Ronald A. Sandler; Richard A. Craig

[57] ABSTRACT

A reflective roadway delineator for reflecting incident light directed thereon by an oncoming vehicle back to the vehicle, the delineator being capable of being mounted upon either a roadway barrier having a planar longitudinally extending surfaces thereon or in the generally U-shaped trough of a longitudinally extending highway guard rail. The delineator comprises a base member having at least two different mounting surfaces thereon. One of the surfaces is engageable with and complementary to a planar surface of the associated barrier and the other of the surfaces is complementary to and engageable with at least one wall defining the recess of the trough in the associated guard rail. A reflex reflector is fixedly carried by the base member at predetermined angles relative to the mounting surfaces. The reflex reflector, the base member and the mounting surfaces are configurated and arranged such that the reflex reflector will be positioned at substantially the same operating angle relative to the longitudinal axis of either of the associated barrier or guard rail, regardless of whether the delineator is affixed to the barrier planar surface or in the trough of the guard rails. Means is associated with at least one of the mounting surfaces for securing the delineator to the respective associated guard rail or the associated barrier.

22 Claims, 20 Drawing Figures

FIG. 1 Prior Art
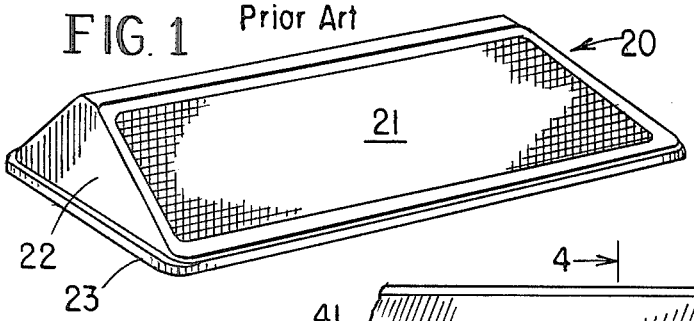
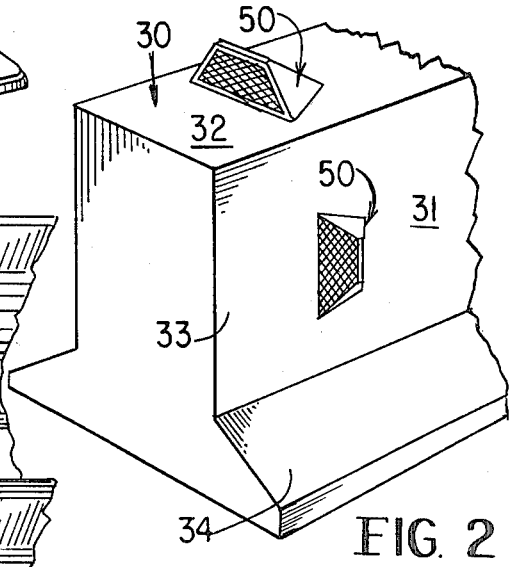
FIG. 2
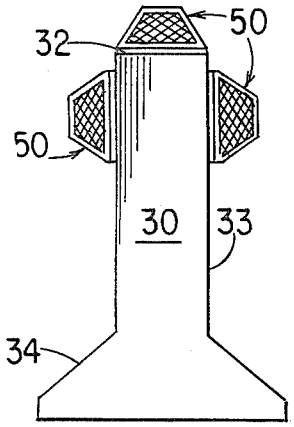
FIG. 2A
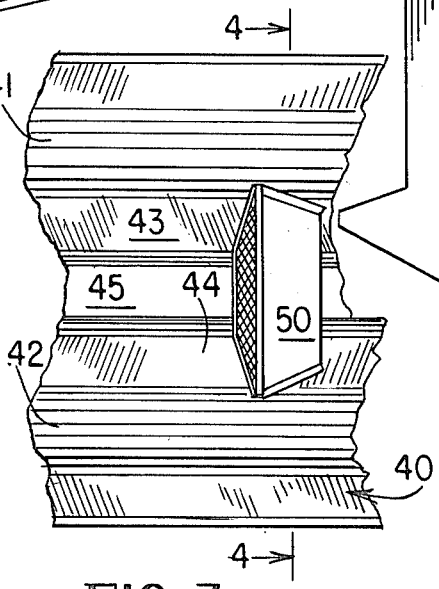
FIG. 3
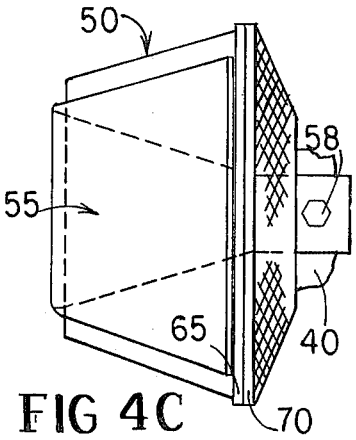
FIG 4C
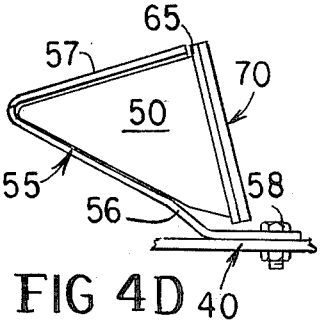
FIG 4D
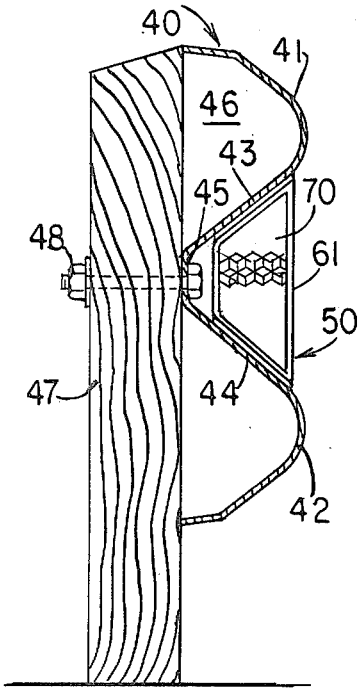
FIG. 4A
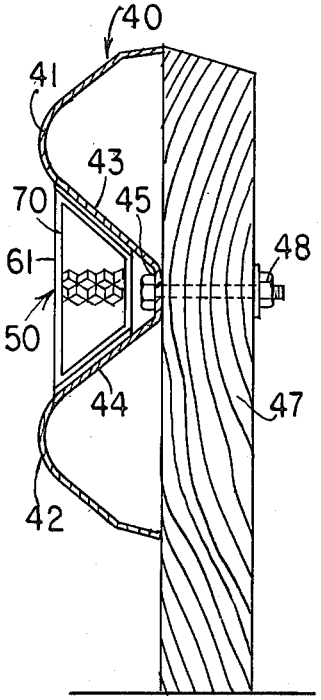
FIG. 4B

HIGHWAY DELINEATOR

BACKGROUND OF THE INVENTION

This invention relates to reflex reflective type highway delineators particularly useful for mounting upon median barriers or guard rails so that the highway directional conditions will be more clearly apparent to a vehicle driver. More particularly, the invention relates to a highway delineator which readily can be mounted upon either metal guard rails or concrete barriers, both frequently used in a median area for separating oppositely flowing traffic.

The use of some form of median dividing structure for separating oppositely flowing traffic in modern highway design is well known. Generally this use consists of either a longitudinally extending barrier set along a median portion of the roadway for dividing traffic while minimizing the glare effect of oncoming traffic headlights; or, alternatively, the use of a continuous guard rail formed of sheet iron or steel and contoured into a generally W-shaped arrangement, vertically mounted on wooden or metal posts. In this case, a longitudinally extending U-shaped through or recess is provided between the upper and lower buffer or guide portions of the rail.

It is well known in modern highway design to utilize various types of reflex reflective marking devices along the highway. The term reflex reflector as used herein is intended to encompass all those forms of reflectors which receive an incident beam of light from an oncoming vehicle and generally reflect the light back to the vehicle so that the reflector serves as a signal device for the driver to indicate the highway edge or as lane delineators.

Applicants' assignee has sold pavement markers such as those found in Heenan U.S. Pat. No. 3,332,327 for this purpose for many years. Similarly, other forms of reflex reflective devices have been mounted on spaced poles along the side of the highway where pavement markers could not be conveniently used.

In order to enhance the safety accomplishments achieved by this reflectorization concept as applied to highway design, there have been numerous attempts to provide reflectorized markings on the concrete barriers or metal guardrails, so that the highway edge will be more clearly delineated at night and under inclement weather conditions. With high speed, multiple lane turnpike driving, it is important that the change in roadway direction be more clearly apparent so the driver has more time to react to conditions.

DESCRIPTION OF PRIOR ART

Mounting of reflectors on highway median dividers frequently has been attempted in the past. One method is the mounting on a bracket of a standard circular type reflector frequently found on posts. The problem with such units in a metal guard rail is they frequently extend beyond the buffer or guide portion, and when vehicles brush against the units, they easily break or become dislodged. Also, the buffer or guide portions frequently are used by maintenance crews to guide lawn mowing equipment, which also damages the reflectors.

Another attempt at delineation on barriers consisted of the mounting of an unmetallized, unfilled version of the Heenan U.S. Pat. No. 3,332,327 marker such as is illustrated in FIG. 1 of the drawings herein. However, that marker did not have adequate reflective area therein. It does not provide adequate reflectivity over a great enough entrance angle range so as to be substantially effective, and in order to mount such marker in the U-shaped trough of a guard rail, some form of bracket or other mounting arrangement would be required, and, also, its shape would cause it to extend beyond the rail.

Another type of barrier delineator known to applicants consists of an L-shaped member in which each leg of the L was provided with a reflex reflective surface. One leg of the L was fastened to the median dividing structure. However, such device could not withstand any substantial contact on the outwardly extending leg of the L without suffering some structural damage, nor was the device entirely satisfactory from a reflective standpoint.

Another form of arrangement for mounting a reflector in the through of a guard rail is suggested in U.S. Pat. No. 4,000,882, in which a substantialy elongated deformable member is positioned over a rather long length of the guard rail, with some type of reflective device positioned at spaced sections therealong. However, that device is not useable with or on the concrete-type barriers, nor is that device economically feasible, as the long length of the deformable portion which fits in the U-shaped trough is exceedingly expensive for the minimal amount of reflectivity gained thereby.

Other disadvantages of the prior art devices result from the fact that they could not be conveniently mounted on either the concrete barrier median dividing structure or the steel guard-rail-type structure. A highway department would be required to have two different types of delineating or mounting systems available, depending upon the particular form of median structure a contractor or maintenance crew might encounter. To obviate these and other difficulties, applicants have invented the novel delineator of the present invention.

OBJECTS AND SUMMARY OF THE INVENTION

It is a primary object of the invention to provide a simple and effective reflex reflective roadway delineator capable of being mounted upon a roadway barrier having planar, longitudinally extending surfaces such as the concrete barrier median dividers, or alternatively within a U-shaped trough of the longitudinally extending guard rails. According to the principles of the present invention, an important object of the invention is the shape of the delineator that allows it to be mounted against either a flat planar face of the barrier or in the trough of the guard rail, while maintaining the face angle of the reflector in either condition.

Another feature of the present invention is the use of a pressure-sensitive adhesive pad to secure the delineator in the U-shaped trough or on the concrete barrier. The use of the pressure-sensitive adhesive pads, combined with the unique shape of the delineator, results in extremely high attachment strength to the guard rail, because of the magnification of the mounting forces thereon.

Another feature of the present invention is the particular optical design of the reflex reflector which enables the reflector to achieve wide entrance angles acceptable in the direction of vehicle travel, whereby the reflector provides substantial reflectivity regardless of whether it is positioned in a horizontal plane on top of a concrete barrier, or in the vertical position in the U-shaped trough of the guard rail.

It is a further object of the invention to provide a delineator for highway guard rails and barriers which, in the preferred form thereof, positions the reflectorized portion thereof in a maximum light-reflecting position for high visibility to the drives of oncoming vehicles, regardless of the disposition of the delineator in a vertical or horizontal position.

Another advantage achieved by the present invention is the fact that the delineator is essentially self aligning when disposed in a U-shaped trough of the guard rail, thereby facilitating placement of the marker in the proper position and minimizing installation time.

An object of the invention is to provide a reflective roadway delineator adapted to be mounted on some form of median dividing structure, the delineator comprising a base member having a pair of sidewalls, a bottom wall, and a reflector mounting surface defined by the sidewalls and the bottom wall. A reflex reflector is carried by the base member on the reflector mounting surface. The base member has two different mounting surfaces thereon consisting on the one hand of the sidewalls which are engageable with and complementary to the walls defining the recess of the U-shaped trough in the associated guard rail, while the other mounting surface consists of the bottom wall of the base member, which wall is complementary to the planar surface of an associated barrier. The reflex reflector is fixedly carried by the base member at predetermined angles relative to the sidewalls and bottom wall. The reflex reflector and the base member and the mounting surfaces are configurated and arranged such that the reflex reflector will be positioned at substantially the same operating angle relative to the longitudinal axis of either the associated barrier or guard rail, regardless of whether the delineator is affixed to the barrier planar surface or in the trough of the guard rail.

In yet a further embodiment of the invention, self-adhesive means is associated with the mounting surfaces for facilitating securement of the delineator to the respective one of either the associated guard rail or median barrier.

It is yet another object of the invention to provide a barrier delineator which has a body member in the form of a truncated trapezoidal pyramid, the reflector constituting one wall of the pyramid and wherein other walls of the pyramid constitute the mounting surfaces, whereby the delineator can be securely fastened and mounted upon the respective guard rail or barrier.

Further features of the invention pertain to the particular construction of the delineator, whereby the above-outlines and additional operating features thereof are obtained.

The invention, both as to its organization and method of operation, together with further objects and advantages thereof, will best be understood by reference to the following specification, taken in connection with the accompanying drawings.

BRIEF DESCRIPTION OF THE DRAWINGS

FIG. 1 is a perspective view of a pavement marker of the type previously used on barriers as a form of delineator;

FIG. 2 is a perspective view illustrating a typical concrete barrier on which delineators of the present invention have been mounted for illustrative purposes;

FIG. 2A is an end view of a barrier such as illustraded in FIG. 2, on which a plurality of delineators have been mounted for illustrative purposes, the illustrated delineators being shown out of proportion to the barrier;

FIG. 3 is a fragmentary front elevational view of a conventional metal-type guard rail having a delineator constructed in accordance wtih the present invention mounted thereon;

FIG. 4A is an end view taken in the direction of the arrows 4—4 in FIG. 3 and illustrating a delineator of the present invention in a trough of a steel guard rail;

FIG. 4B is a view similar to FIG. 4A but with the delineator positioned on a guard rail disposed on the opposite side of the highway;

FIG. 4C is a plan view of the delineator shown with an alternate mounting arrangement;

FIG. 4D is a view taken in the directions of the arrows 4D—4D in FIG. 4C and further illustrating details of an alternate mounting bracket;

DESCRIPTION OF THE PREFERRED EMBODIMENT

Figure 5:
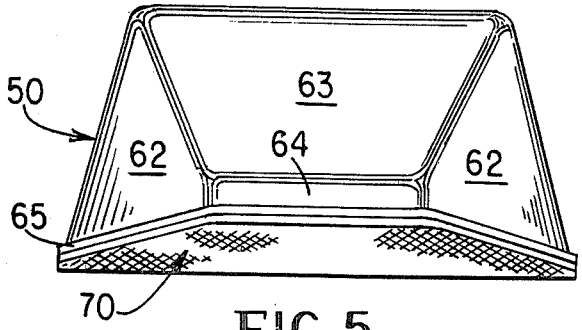
FIG. 5 is a plan view of a delineator constructed in accordance with the present invention.

With reference to FIG. 1 of the drawings, there is illustrated a pavement marker of the type manufactured in accordance with applicants' assignee's U.S. Pat. No. 3,332,327, having a shape substantially similar to that disclosed in applicant' assignee's U.S. Pat. No. 3,790,293. Such pavement marker is designated generally by the numeral 20 and has front face 21 intended to be inclined at an angle of approximately 30° to the roadway surface when the marker 20 is adhered at the bottom wall 23 thereof to the associated roadway. Pavement markers of this type have, as has previously been discussed, been mounted on the planar surface of a concrete median barrier; however, such markers do not provide sufficient reflectivity over the greater entrance angle desired for barrier delineators, nor can they be readily mounted in the trough of a metal guard rail.

To this end, the delineators designated generally by the numeral 50, are shown in various mounting positions, on an associated concrete barrier 30, as seen in FIGS. 2 and 2A, and in the trough of a portion of an elongated metal guard rail 40 as illustrated in FIGS. 3 and 4A and 4B.

The concrete barriers or median dividers are well known in the art and consist generally of an elongated main body portion 31 that is disposed adjacent to the roadway surface, usually in the median area dividing oppositely flowing highway lanes. The barrier 30 has a planar top wall 32, a pair of planar sidewalls 33, and an enlarged base 34 whereby the unit is securely set upon the roadway, the base 34 providing additional stability and guidance in the event a vehicle strikes the surface thereof.

The elongated guard rail 40 is generally W-shaped in configuration and is mounted in a vertical position upon wooden or metal uprights 47, as best seen in FIGS. 4A and 4B, by bolts 48 or other fastening means, not part of the present invention. The guard rail is generally substantially elongated and includes upper and lower buffer or guide portions 41 and 42, and including inwardly directed walls 43 and 45, respectively, connected by a bight portion 45, the walls 43 and 44 and bight portion 45 defining a longitudinally extending generally U-shaped trough in the guard rail 40.

If the walls 43 and 44 are extended to a point of intersection, they would define an included angle of approximately 70° therebetween. One feature of the present invention, as hereinafter discussed, allows the delineator 50 to be accurately positioned within the trough 46, even though there may be some slight variations in the included angle between the inclined faces 43 and 44 defining the trough.

Figure 6:
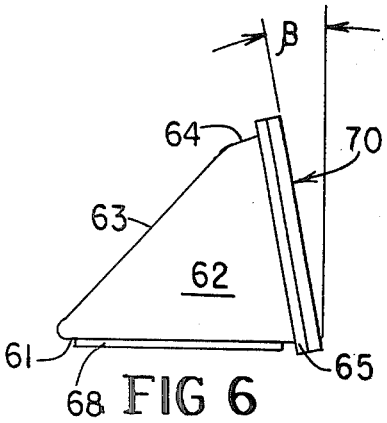
FIG. 6 is an end view of the delineator illustrated in FIG. 5, with the preferred form of mounting means thereon for positioning such delineator on the horizontal surface of a barrier.
Figure 7:
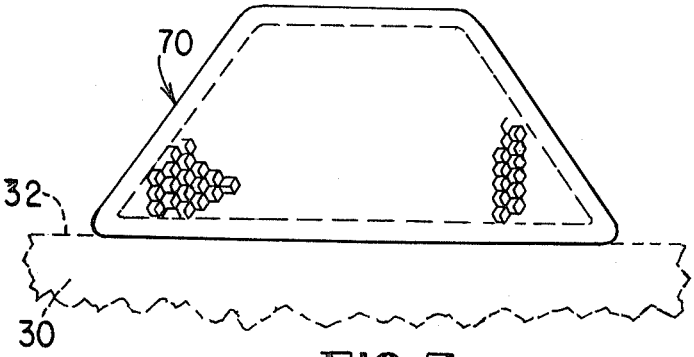
FIG. 7 is a front elevational view of the delineator of FIG. 5.
Figure 10:
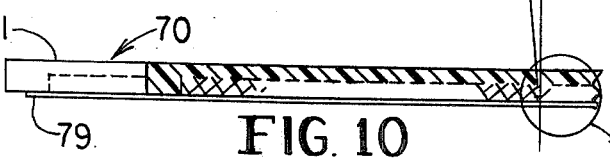
FIG. 10 is an enlarged fragmentary sectional view of the reflector, taken in the direction of the arrows 10—10 in FIG. 8.
Figure 10A:
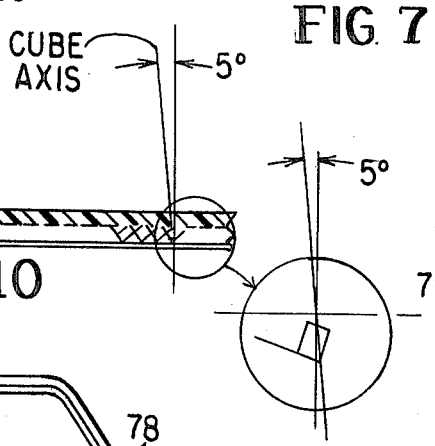
FIG. 10A is an enlarged view of the encircled portion in FIG. 10, illustrating with greater clarity the reflector arrangement of the present invention.
Figure 8:
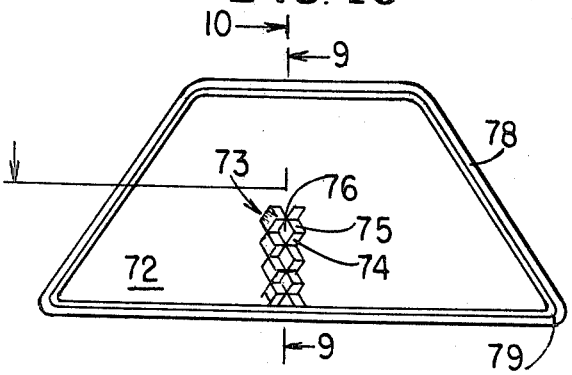
FIG. 8 is a rear view of the preferred form of reflex reflector utilized in conjunction with the present invention.
Figure 9:
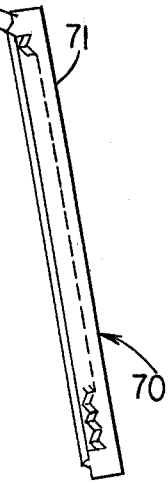
FIG. 9 is an enlarged sectional view of the reflector, taken in the direction of the arrows 9—9 in FIG. 8.
Figure 12:
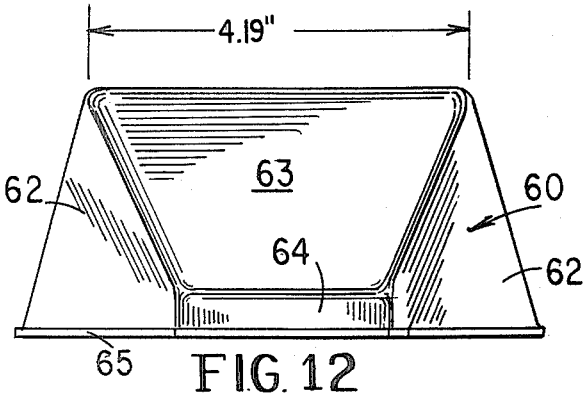
FIG. 12 is a plan view of the base member illustrated in FIG. 11.
Figure 11:
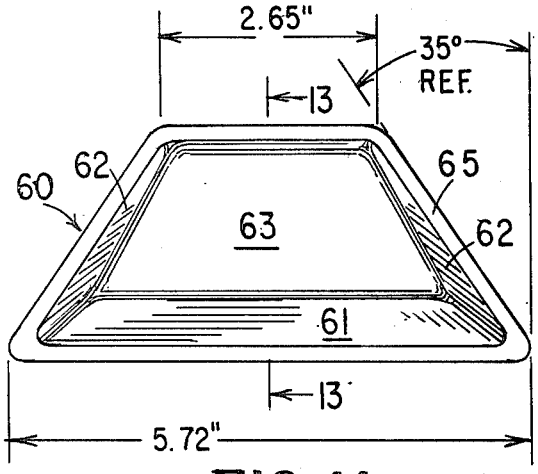
FIG. 11 is a front elevational view of the base member forming part of the delineator and illustrating the interior and other constructional details thereof.
Figure 13:
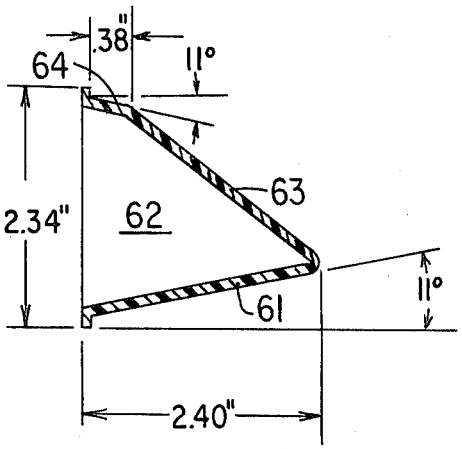
FIG. 13 is a sectional view of the base member, taken in the direction of the arrows 13—13 of FIG. 11.
Figure 14:
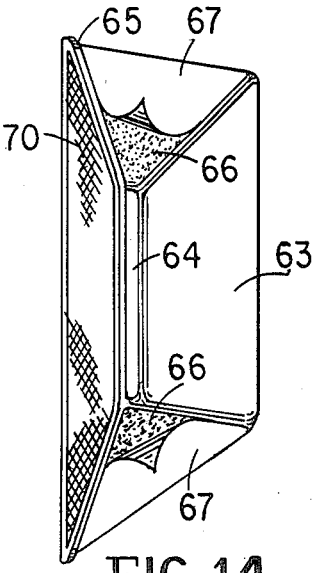
FIG. 14 is a plan view of the delineator illustrating the relationship of the release paper, and adhesive mounting pads, on the delineator prior to installation in a metal guard rail.
Figure 15:
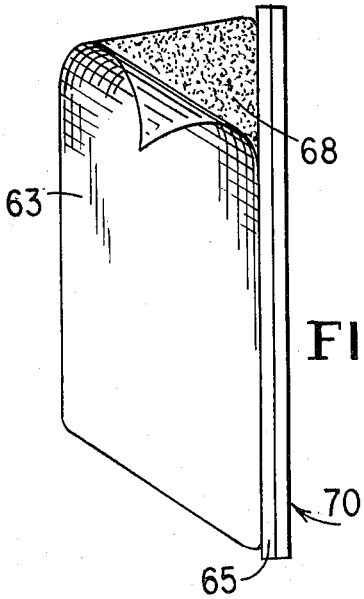
FIG. 15 is a bottom view of the marker of FIG. 14, illustrating the alternate positioning of the adhesive mounting pads when the delineator is to be secured to a barrier.

The structure of the delineator 50 is best seen in FIGS. 5 through 7, and is seen to include a base member 60, preferably formed of a synthetic resin such as acrylic or the like, to which is rigidly secured a reflex reflector lens designated generally by the numeral 70. The structure of the base member is best seen in FIGS. 11 through 13, and includes a bottom or outer wall 61, from which rise a pair of inclined sidewalls 62 at a compound angle relative thereto. The base member 60 further includes a top or inner wall 63 which is inclined upwardly from the bottom wall 61 of base member 60. The bottom wall 61 is generally trapezoidal in plan configuration, and, as viewed in FIGS. 5 and 6, and considering the bottom wall 61 to define the base of a pyramid formed by the sidewalls 62, reflex reflector 70, and top wall 63, the delineator 50 takes the form of a trapezoidal pyramid. The reflex reflector 70, as viewed in the plan view (FIG. 7), also is trapezoidal in configuration. Moreover, for reasons hereinafter noted, the top wall 63 is truncated to provide a shoulder portion 64 thereon; the shoulder portion 64 serving as a reference shoulder for tooling purposes, as well as providing a large enough area to facilitate normal positioning of the delineator on the associated underlying support structure.

As seen in FIGS. 11–13, the other edges of the sidewalls, bottom wall and top wall intersect and are provided with an outwardly extending peripheral flange 65 defining a mounting area for the reflex reflector 70. The flange 65 further facilitates the positioning of the preferred securement means, as hereinafter described.

The illustrated preferred reflex reflector 70 for use with the invention consists of cube-corner-type reflector; however, it should be understood that other forms of reflex reflectors could be utilized herein. The reflector 70 is comprised of a transparent synthetic resin such as acrylic or the like, and includes a generally planar front face 71 and a configurated rear surface 72 having formed thereon a plurality of cube-corner elements 73 in a manner well known in the art. Each cube-corner element 73 has three planar surfaces 74, 75, 76 arranged mutually at right angles and meeting at a common point remote from the front face 71 to form the respective cube corner. Each cube corner 73 also has a cube axis passing through the apex of the faces. Normally, for optimum reflectivity, the cube axis would be aligned with the nominal refracted ray. Usually the ray lies perpendicular to the front face of the reflector, so that the cube axis would lie parallel to the ray and normal to the front face. It is known, and as disclosed for example in U.S. Pat. No. 3,332,327, to incline the cube axis so that it is parallel to the refracted ray when the face of the reflector is intended to be inclined at an angle to the nominal incident ray. However, in a preferred embodiment of the reflector, the cube axis actually is inclined so that it is not parallel to the nominal refracted ray. It is also known that tilting of the reflector axis so that one or more of the faces thereof is more parallel to the front face, will have a significant effect on the reflectivity of the unit in response to incident light at various entrance angles. Generally speaking, it is desirable that the incident light not be directed primarily onto a face of the cube-corner element, but rather into the line of intersection between adjacent faces.

One aspect of the present invention, however, is the inclination of the cube axis at an angle of 5° relative to the normal to the front face of the reflector and in a plane extending toward the sidewalls of the reflector 70 and perpendicular to the front face (a vertical plane as the device is mounted in the positions illustrated in FIG. 4, for example) whereby substantially symmetrical reflex performance will be obtained regardless of whether the delineator 50 is mounted against the wall 33 of a barrier 30, as illustrated in FIG. 2A, wherein the bottom wall 61 of the base member 60 is adhered to the barrier sidewall 33, or in the U-shaped trough 46, in which case the bottom wall 61 faces outwardly, as in FIG. 4A. It will be observed that the delineator 50 may be effectively rotated 180° and nevertheless will yield substantially the same degree of reflectivity when mounted on either a barrier wall or guide rail disposed along the same side of the roadway.

Another important advantage attained by the present invention is that by inclining the cube axis angle in the vertical plane, and orienting the cube around the axis so that the incident light more nearly hits one of the faces of the cube corner; and in particular by inclining that face such that it will be directed to the right, as viewed in FIG. 7, the result is such that when the delineator 50 is positioned on the top wall 32 of the barrier 30 the cube face would be generally to the right. As these barriers are normally positioned to the left of the roadway, the tilt of the cube axis, and face, toward the right, serves to increase the angular acceptance of the reflector when disposed horizontally, as in FIG. 7.

It is believed that satisfactory reflectivity can be obtained with the cube axis inclined in a range of between about 2½° to 11°, with the 5° angle preferred for the entrance angles anticipated. This range would be acceptable with the front face of the reflector inclined in the range of between about 5° and 18° relative to a normal to the road traffic.

While it is believed that inclining the cube axis 5° from the normal, as noted herein, may yield the best reflectivity for the particular tilt or operating angle of the front face of the reflector relative to road traffic, it should be understood that acceptable results might be obtained with the cube axis normal to the front face, but under this condition the tilt of the front face should be increased to the upper end of the 5°–18° range.

To complete the description of the reflector 70, it will be observed that the reflector body has a peripheral flange thereon intended to overlie the flange 65 on base member 60 and be in fixed engagement therewith. As it is desirable to utilize a hollow body for the base member, it is necessary that a hermetic seal be provided between the reflector 70 and base 60. To accomplish this a sealing bead 79 is originally formed on flange 78, the bead essentially focusing the energy during ultrasonic welding of the reflector to the base.

As previously noted, an important feature of the present invention is the construction and arrangement of the delineator such that even though mounted in the trough of a guard rail, or on a barrier, the reflex reflector 70 will be inclined at a predetermined angle relative to the flow of traffic on the adjacent roadway. The particular truncated trapezoidal pyramidal structure of the base member, in cooperation with the reflex reflector, permits this essentially universe mounting of the delineator.

Moreover, it is desirable that the reflector 70 be able to return a signal through an entrance angle 35° inward from the plane of the mounting surface. Normally, there is a significant drop-off in reflectivity when the entrance angle exceeds 20°. In order to increase the entrance angle acceptance in the direction of the road, and to improve the cleanability of the reflector, the front face of the reflector is preferably positioned somewhere in the range of between about 5° and 18° relative to the normal to roadway traffic. The preferred angle of 11° will allow symmetrical reflex performance, regardless of whether the faces 76 of the cubes are up or down, when the delineator is placed in either vertical orientation such as in FIGS. 4A or 4B. To accomplish this, the front face 71 of the reflector 70 preferably is disposed at an angle of 11° relative to the bottom wall 61.

As best seen in FIGS. 6 and 13, when the base member 60 is positioned such that the bottom wall 61 is in a horizontal plane, the front face 71 of the reflector will be inclined at an angle of approximately 11° relative to the normal to the horizontal; or an angle of approximately 79° from the bottom wall. When the delineator 50 is mounted on a barrier 30, regardless of the wall on which the delineator is mounted, the front face 71 will always be inclined rearwardly in the direction of traffic flow approximately 11° from the normal to that traffic flow.

The sidewalls 62 and top wall 63 of the base member 60 are further configured and arranged such that when the delineator 50 is placed in the U-shaped trough 46, the sidewalls 62 serve to properly guide and mount the delineator 50 in a relatively rigid position, whereby the front face 71 continues to be inclined at the selected operating angle of 11° relative to the normal to the direction of traffic flow.

To best visualize this geometric arrangement, and noting that the sidewalls 62 form a compound angle relative to the trapezoidally shaped bottom wall, the angularity of the sidewalls can best be visualized as lying in planes parallel and juxtaposed to the walls 43 and 44 of the guard rail when the reflector front face 70 is at the selected angle (11°) to a plane vertical to the guard rail cross section, or, in other words, when the shoulder 64 is parallel to the bight 45 of the rail 40. The shoulder preferably is formed at an angle of approximately 11° relative to the normal to the plane defined by the peripheral flange 65 (which in turn delineates the mounting area for the reflector 70). The included angle defined by the planes of the sidewalls 62 intersecting that shoulder portion 64 is then approximately 35° from the plane of the shoulder portion.

In order to further understand the proper geometric relationship of the sidewalls 62 to the reflector front face 71 and the bottom (or outer) wall 61, it will be understood that the angle of the line defined by the intersection of the planes of the sidewalls 62 to the front face 71 is equal to the angle between the front face 71 and the bottom wall 61.

This relationship perhaps can better be understood with respect to a specific embodiment, and, for the purposes of illustration, the dimensions of the preferred embodiment have been noted on the drawings, although the drawings may not necessarily be to scale.

The delineator 50 preferably is secured to the guard rail 40 or barrier 30 by means of adhesive pads of a butyl composition. A pair of pads 66 may be disposed on the sidewalls 62, whereupon, after removal of the usual release paper 67, the delineator may be wedged into the trough 46 of the guard rail 40, the configuration of the walls 62 serving properly to align the reflector face 71 at the predetermined angle.

Alternatively, when the delineator is to be mounted on a barrier 30, the bottom wall 61 is provided with the adhesive pad 68. The outwardly extending flange 65 on the base serves to locate these pads when applied to the base 60, and also prevents any material from overlying the reflex area.

To install the unit, the underlying surface is cleaned and dried, and loose dirt, concrete, paint or the like, is wire brushed away; a suitable primer (such as sold by the Signal Products Division, Amerace Corporation, 2202–017) is applied to the cleaned surface, and allowed to dry. The release paper 67 is removed from the adhesive pads 66 or 68 on the delineator, and the delineator is installed on the primed areas with the reflex facing the oncoming traffic. Preferably a 25–50 pound load is then applied to the delineator for 3–6 seconds to assure that the adhesive pad sets. When applying the delineator on a barrier, the shoulder 64 serves as the area at which such force can be conveniently applied. When installed on a guard rail, the wedging action provided by the sidewalls 62 assures that a great shear force will be required to remove the reflector—thus minimizing accidental dislodgement and vandalism. Moreover, the pads will also accommodate some deformity of the trough both in installation and use.

In those circumstances where the metal guard rail is too oxidized, or has been painted, and a good bond cannot be assured, a mechanical mounting device 55 (FIGS. 4C and 4D) can be utilized. That device includes a generally U-shaped bracket having a fastening arm 56 and a gripping arm 57. The arm 56 may be secured by a bolt 58 or the like through one of the extra bolt holes normally found in the guard rail 40; the release paper is removed from the pad 68 on the bottom wall, and the delineator can then be wedged into place in the bracket so that the gripping arm provides a compressive force against the pad 68, or wall 61, if no pad is provided.

While there has been describdd what is at present considered to be the preferred embodiment of the invention, it will be understood that various modifications may be made therein, and it is intended to cover in the appended claims all such modifications as fall within the true spirit and scope of the invention.

What is claimed is:

1. A reflective roadway delineator for reflecting incident light directed thereon by an incoming vehicle back to the vehicle, the delineator being capable of being mounted upon either a roadway barrier having planar longitudinally extending surfaces thereon or in the generally U-shaped trough of a longitudinally extending highway guard rail, the delineator comprising: a base member including a pair of side walls, a bottom wall and a top wall, said bottom wall comprising a first mounting surface for securing the delineator to an associated barrier or guard rail; said side walls comprising a pair of second mounting surfaces for securing said delineator in the trough of an associated guard rail; one set of intersecting edges of said walls defining a mounting area; a reflex reflector fixedly carried by said base member on said mounting area at predetermined angles relative to said mounting surfaces; said reflex reflector, said base member and said mounting surfaces being configurated and arranged such that said reflex reflector will be positioned at substantially the same operating angle relative to the longitudinal axis of either of the associated barrier or guard rail, regardless of whether the delineator is affixed to the barrier planar surface or in the trough of the guard rail; and means associated with at least one of said mounting surfaces for securing said delineator to the respective associated guard rail or the associated barrier.

2. The roadway delineator set forth in claim 1, wherein said reflex reflector and said base member are each formed of a synthetic resin.

3. The roadway delineator set forth in claim 1, wherein said bottom wall is trapezoidally shaped and said sidewalls, said top wall and said reflex reflector are inclined relative thereto to define a trapezoidal pyramid.

4. The roadway delineator set forth in claim 3, wherein said top wall and the upper edge of said reflex reflector are truncated, said reflex reflector being generally trapezoidal in shape, said delineator being spaced from the inner surface defining the U-shaped trough when said delineator is mounted in the associated guard rail.

5. The roadway delineator set forth in claim 4, wherein said reflex reflector includes a generally planar light-receiving front face inclined at an angle in the range of between about 72° and 85° relative to said bottom wall, whereby said front face of said reflector will be rearwardly inclined at an angle of between about 5° and 18° relative to a plane normal to the direction of traffic when the delineator is mounted upon an associated barrier.

6. The roadway delineator set forth in claim 3, wherein said reflector includes a generally planar front face and said sidewalls are arranged so that the angle between a line defined by an extension of the planes of the sidewalls and said reflector front face is equal to the angle between said reflector front face and said bottom wall, whereby said reflector will be inclined at the same relative angle to the flow of traffic if the delineator is mounted on an associated guard rail or barrier.

7. The roadway delineator set forth in claim 6, wherein the angle between said front face of said reflector and said bottom wall is in the range of about 72° and 85°.

8. The roadway delineator set forth in claim 6, wherein the angle between said front face of said reflector and said bottom wall is about 79°.

9. The roadway delineator set forth in claim 3, wherein said reflex reflector includes a generally planar light-receiving front face inclined at an angle in the range of between about 72° and 85° relative to said bottom wall, and said bottom wall and sidewalls are configured and arranged such that said front face of said reflector will be rearwardly inclined at an angle of between 5° and 18° relative to a plane normal to the direction of traffic when the delineator is mounted either upon an associated barrier or in the trough of an associated guard rail.

10. The roadway delineator set forth in claim 3, wherein said sidewalls and said reflex reflector are dimensioned and arranged relative to said bottom wall such that the light-receiving front face of said reflex reflector will be inwardly inclined at an angle of between 5° and 18° relative to a plane normal to the direction of traffic when the delineator is mounted within the trough of an associated guard rail.

11. The roadway reflector set forth in claim 10, and wherein said front face of said reflec reflector is inclined at an angle of about 79° relative to said bottom wall whereby said front face of said reflex reflector will be rearwardly inclined at an angle of about 11° relative to a plane normal to the direction of traffic flow when the delineator is mounted upon an associated barrier or in the trough of an associated guard rail.

12. The roadway delineator set forth in claim 3, wherein said reflex reflector comprises a cube-corner-type reflector having a generally planar light-receiving front face and a rear face having a plurality of cube-corner elements formed thereon, each of said reflector elements having three planar surfaces arranged mutually at right angles and meeting at a common point remote from the front face to form a cube corner, and an axis passing through the cube corner of each reflector element, the axes of the reflector elements being parallel and lying in planes inclined at an angle in the range of between about 2½° to 11° relative to a normal to the front face of the reflector and in planes parallel to the leading edge of the base of the reflector and perpendicular to the front face of the reflector.

13. The roadway delineator set forth in claim 12, wherein said cube axis is inclined at an angle of about 5° to the normal to the front face.

14. The roadway delineator set forth in claim 12, wherein said cube corners are oriented around their respective axes such that one face thereof will be more generally parallel to the front face of said reflector so that the nominal entering light rays will be directed primarily into said face.

15. The roadway delineator set forth in claim 14, wherein said one face will be oriented to the right of the cube axis when looking toward the face of the reflector and when the delineator is positioned such that said bottom wall lies in a horizontal plane.

16. The roadway delineator set forth in claim 3, wherein said means for securing said delineator to the associated barrier or guard rail comprises adhesive pads disposed on one or more of said mounting surfaces whereby said pads, when placed in contact with the associated underlying support surface will cause said delineator to be securely fastened thereagainst.

17. The roadway delineator set forth in claim 16, wherein a pair of said mounting pads is disposed on the opposite sidewalls of said base member whereby said sidewalls serve to cooperate with the associated walls of the trough of a guard rail for securing the deflector thereagainst.

18. The roadway delineator set forth in claim 16, wherein said adhesive pad is carried by said bottom wall of said base member whereupon positioning said bottom wall against the planar surface of an associated barrier will effect secure attachment of said delineator to the associated barrier.

19. The roadway delineator set forth in claim 3, wherein said means for securing said delineator to the associated guard rail or barrier comprises a generally U-shaped bracket having a fastening arm complementary to said top wall and a gripping arm complementary to said bottom wall of said base member, said fastening arm having an aperture therethrough to receive fastening means for securing said bracket to an underlying support surface.

20. A reflective roadway delineator for highway guard rails of the type having a generally U-shaped trough formed therein and extending longitudinally thereof, the delineator comprising: a base member having a pair of sidewalls, a top wall, a bottom wall and a reflector mounting surface defined by said sidewalls, said top wall and said bottom wall; a reflex reflector having a generally planar front face, said reflector being carried by said base member on said reflector mounting surface; said sidewalls and said bottom wall being so arranged such that upon placement of said base member in the associated trough, said sidewalls will generally conform to and be in engagement with the walls defining said trough, said reflex reflector being positioned at a predetermined angle in said trough so that said front face will be rearwardly inclined at an angle of between about 5° and 18° relative to a plane normal to the direction of traffic for reflecting light incident thereon back toward the oncoming vehicle, said base member and said reflector all being disposed within the recess defined by said trough; and means for securing said base member to said guard rail.

21. The roadway delineator set forth in claim 20, wherein said bottom wall is trapezoidally shaped and said sidewalls, said top wall and said reflex reflector are inclined relative thereto to define a trapezoidal pyramid.

22. The roadway delineator set forth in claim 21, wherein said top wall and the upper edge of said reflex reflector are truncated, said reflex reflector being generally trapezoidal in shape, said delineator being spaced from the inner surface defining the U-shaped trough when said delineator is mounted in the associated guard rail.

* * * * *